US007661985B2

(12) United States Patent
Ishikawa

(10) Patent No.: US 7,661,985 B2
(45) Date of Patent: Feb. 16, 2010

(54) CONNECTOR

(75) Inventor: Ryotaro Ishikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/266,626

(22) Filed: Nov. 7, 2008

(65) Prior Publication Data

US 2009/0124114 A1 May 14, 2009

(30) Foreign Application Priority Data

Nov. 12, 2007 (JP) ..... 2007-293254

(51) Int. Cl.
*H01R 13/40* (2006.01)

(52) U.S. Cl. ..... 439/595

(58) Field of Classification Search ..... 439/595
See application file for complete search history.

(56) References Cited

U.S. PATENT DOCUMENTS 4,127,314 A * 11/1978 Hasimoto ..... 439/603
7,374,465 B2 * 5/2008 Tanaka ..... 439/852
2001/0006861 A1 * 7/2001 Ohsumi ..... 439/752
2004/0082219 A1 * 4/2004 Tabata et al. ..... 439/595
2004/0192109 A1 9/2004 Fukatsu et al.
2004/0203287 A1 * 10/2004 Itou et al. ..... 439/595
2005/0085126 A1 * 4/2005 Sagawa et al. ..... 439/595
2007/0111599 A1 * 5/2007 Tanaka ..... 439/595

FOREIGN PATENT DOCUMENTS

JP 2004-362831 12/2004

* cited by examiner

*Primary Examiner*—Ross N Gushi
(74) *Attorney, Agent, or Firm*—Gerald E Hespos; Anthony J. Casella

(57) ABSTRACT

A locking projection (18) projecting from a cantilever-shaped locking lance (16) extending forward along an inner wall of a cavity (11) includes a first locking area (18*a*) and a second locking area (18*b*). The first locking area (18*a*) is arranged at a projecting end of the locking projection (18) and is engaged with a terminal fitting (30) in a state where the locking lance (16) is not resiliently deformed. The second locking area (18*b*) is arranged at a base end of the locking projection (18) and is not engaged with the terminal fitting (30) in the state where the locking lance (16) is not resiliently deformed, but engaged with the terminal fitting (30) by the resilient deformation of the locking lance toward the cavity.

11 Claims, 6 Drawing Sheets

CONNECTOR

BACKGROUND OF THE INVENTION

1. Field of the Invention

The invention relates to a connector.

2. Description of the Related Art

Japanese Unexamined Patent Publication No. 2004-362831 and FIGS. 5 and 6 of this application disclose a connector with a housing 1 that has a cavity 2 for receiving a terminal fitting 3. A locking lance 4 is cantilevered to extend forwardly along an inner wall of the cavity 2 and can deform into a deformation space 5 as the terminal fitting 3 is inserted into the cavity 2. The locking lance 4 then returns resiliently to retain the terminal fitting 3 in the cavity 2. A removal space 6 opens in the front wall 7 of the housing 1 for a mold that is used to form the locking lance 4. An entrance hole 8 is formed in this front wall 7 so that a tab of a mating terminal (not shown) can enter the cavity 2 from the front. A tapered guiding slant 9 is formed on the front surface of the front wall 7 to surround the entrance hole 8. The guiding slant 9 guides the tab into the entrance hole 8.

The locking lance 4 has a locking projection 4*a* that projects into the cavity 2 for engaging the terminal fitting 3. A part of the guiding slant 9 is cut by the removal space 6. A projecting distance of the locking projection 4*a* from the lock 4 is increased to increase an area of engagement of the locking projection 4*a* with the terminal fitting 3 to improve retaining reliability by the locking lance 4. However, an increase of the projecting distance of the locking projection 4*a* also increases an opening area of the removal space 6. As a result, the cutout area of the guiding slant 9 by the removal space 6 increases to reduce a guiding function by the guiding slant 9.

The invention was developed in view of the above situation and an object thereof is to improve the reliability of a retaining function by a locking lance without reducing a guiding function of a guiding slant.

SUMMARY OF THE INVENTION

The invention relates to a connector with a housing that has at least one cavity for receiving a terminal fitting. A locking lance extends forward along an inner wall of the cavity and is resiliently deformable in a direction intersecting the inserting direction of the terminal fitting into the cavity. A locking projection projects from the locking lance for engaging and retaining the terminal fitting. A first locking area is formed at a projecting end of the locking projection and is engageable with the terminal fitting in a state where the locking lance is not resiliently deformed. A second locking area is formed at a base end of the locking projection and is not engageable with the terminal fitting in the state where the locking lance is not resiliently deformed, but is engageable with the terminal fitting if the locking lance deforms towards the cavity.

The terminal fitting may be displaced back while the first locking area is engaged with the terminal fitting. As a result, the terminal fitting exerts a pressing force on the locking projection from the front and displaces the locking lance towards the cavity. This displacement of the locking lance causes the second locking area to engage the terminal fitting. The second locking area is located at the base end of the locking projection. Thus, an area of engagement of the locking projection with the terminal fitting increases as compared with the state where the locking lance is not resiliently deformed towards the cavity.

An entrance hole preferably penetrates a front wall of the cavity and permits the entry of a mating terminal into the cavity from the front.

A tapered, inclined or converging guiding slant is formed in the front surface of the front wall to at least partly surround the entrance hole and is adapted to guide the mating terminal to the entrance hole.

The mold that forms the locking lance requires a mold removal space that cuts out the front wall. The reduction of the projecting amount of the locking projection into the cavity in the state where the locking lance is not deformed means that a smaller mold removal space is required. Therefore, a large guiding area of the guiding slant can be ensured.

A locking surface of the locking projection that engages the terminal fitting is inclined forward from the base end thereof towards the projecting end in the state where the locking lance is not resiliently deformed. Therefore, the locking lance is pulled reliably towards the cavity by the inclination of the locking surface when a pressing force from front acts on the locking projection from the terminal fitting.

The locking surface preferably is inclined forward from the base end thereof towards the projecting end in a state where the locking lance is deformed towards the cavity. Thus, there is no likelihood that the locking projection is disengaged from the terminal fitting.

A clearance in forward and backward directions preferably is defined between a locking surface of the locking projection and a locking portion of the terminal fitting when the locking lance is deformed.

A length from a locking surface of the locking projection engageable with the terminal fitting to a rear end of the locking projection in the state where the first locking area is engaged with the terminal fitting preferably is substantially equal to a length from the locking surface to the rear end of the locking projection in the state where the second locking area is engaged with the terminal fitting.

A deformation space that permits the resilient deformation of the locking lance preferably communicates vertically with the space before the locking lance to define a mold removal space for removing a mold that forms the locking lance and the deformation space. A direction of removing this mold preferably is substantially parallel to the inserting direction of the terminal fitting into the cavity.

A partition preferably is formed at a front wall of the cavity and at least partly partitions the entrance hole and the mold removal space.

The locking lance preferably has a cantilevered main portion extending substantially forward and preferably having substantially the same width as the locking projection.

These and other features and advantages of the invention will become more apparent upon reading the following detailed description and accompanying drawings. Even though embodiments are described separately single features may be combined to additional embodiments.

DETAILED DESCRIPTION OF THE PREFERRED EMBODIMENTS

Figure 1:
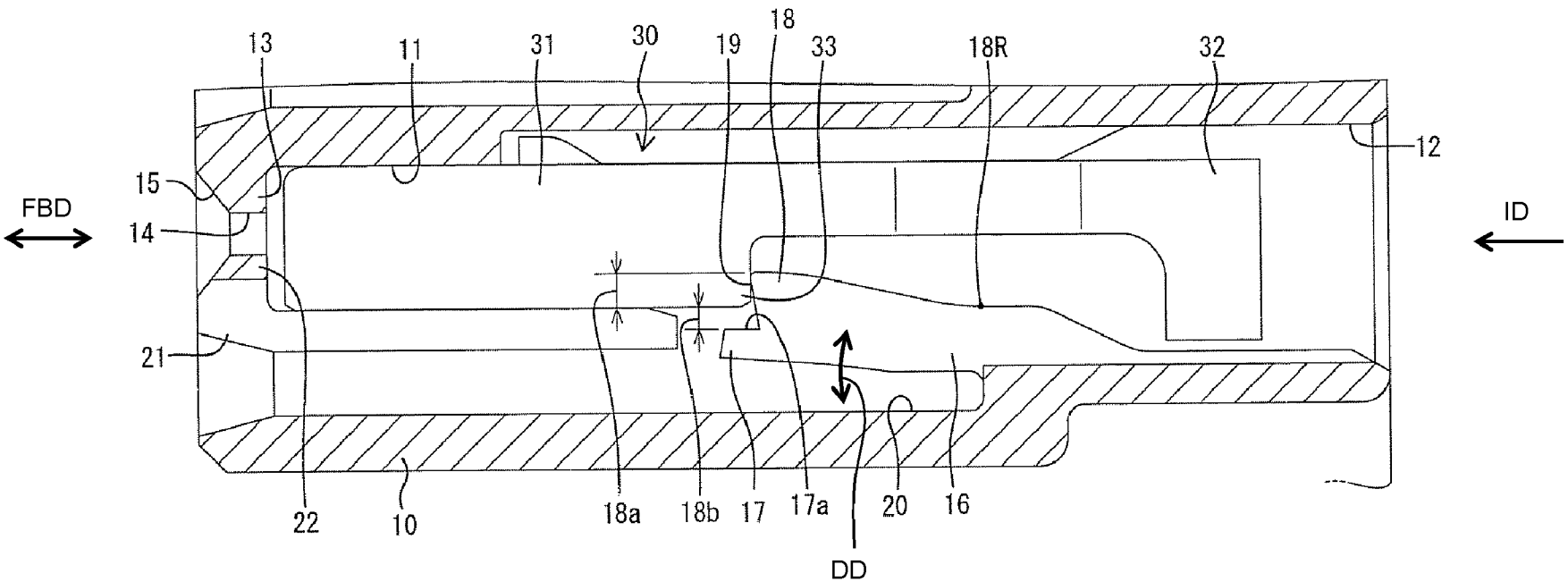
FIG. 1 is a section showing a state where a locking lance is not resiliently deformed towards a cavity.

A connector according to the invention has a housing identified by the numeral 10 in FIGS. 1 to 4. A terminal fitting 30 can be inserted into the housing 10 and is retained by a locking lance 16.

The housing 10 is made unitarily e.g. of synthetic resin and is formed with at least one cavity 11 that is long and narrow in forward and backward directions FBD. A cross-sectional shape of the cavity 11 orthogonal to the forward and backward directions FBD of the cavity 11 is substantially rectangular, and a terminal insertion opening 12 extends into the cavity 11 at the rear end surface of the housing 10 for permitting insertion of a terminal fitting 30 into the cavity 11.

A front wall 13 of the cavity 11 forms part of the front surface of the housing 10 and an entrance hole 14 penetrates the front wall 13 from the front surface of the housing 10 to the front of the cavity 11. The entrance hole 14 is substantially rectangular when viewed along the forward and backward directions FBD and is substantially in the center of the cavity 11 in vertical and lateral directions. Vertical and lateral dimensions of the entrance hole 14 are smaller than vertical and lateral dimensions of the cavity 11. The entrance hole 14 permits a long narrow tab at the leading end of a mating male terminal (not shown) to be inserted into the cavity 11 from the front end of the housing 10. The entrance hole 14 positions the tab vertically and laterally so that the tab is connected with the terminal fitting 30 in a correct positional relationship.

A guiding slant 15 is formed at the front surface of the front wall 13 to at least partly surround the entrance hole 14. The guiding slant 15 is a tapered recess in the front surface of the front wall 13 and includes a trapezoidal first guiding surface 15*a* that is substantially continuous with the upper edge of the entrance hole 14. Two trapezoidal second guiding surfaces 15*b* are substantially continuous with the first guiding surface 15*a* and are at opposite left and right edges of the entrance hole 14. A third guiding surface 15*c* is substantially continuous with the second guiding surfaces 15*b* and the bottom edge of the entrance hole 14. A substantially rectangular removal space 21 is formed in the third guiding surface 15*c* by a cutout in a part of a trapezoidal area vertically symmetrical with the first guiding surface 15*a*. The guiding slant 15 functions as guiding means for guiding the tab of the mating terminal into the entrance hole 14 by its inclination.

The housing 10 is formed unitarily with a cantilevered locking lance 16 that extends substantially forward along the bottom wall of the cavity 11. The locking lance 16 is resiliently deformable while inclining its posture up and down in directions intersecting the inserting direction ID of the terminal fitting 30 into the cavity 11. A base end portion at the rear end of the locking lance 16 is a support for the resilient deformation. The locking lance 16 is arranged at a widthwise central position of the cavity 11, and the width of the locking lance 16 is smaller than the widths of the cavity 11 and the guiding slant 15, but larger than the width of the entrance hole 14. The locking lance 16 is at the central positions of the cavity 11 and/or the entrance hole 14 in a lateral direction.

The locking lance 16 has a forwardly cantilevered main portion 17 that is continuous with the bottom wall of the cavity 11. A locking projection 18 projects from an upper or inner surface 17*a* of the main portion 17 and has substantially the same width as the main portion 17. The main portion 17 is resiliently deformable both toward the cavity 11 and toward a side opposite to the cavity 11 while inclining its posture. The upper surface 17*a* of the main portion 17 is lower than the inner surface of the bottom wall of the cavity 11 when the locking lance 16 is in a free state without being deformed.

The locking projection 18 is long and narrow in forward and backward directions FBD and extends from a position slightly behind the front end of the main portion 17 to a position slightly before the rear end of the main portion 17. A substantially flat locking surface 19 is defined at the front of the locking projection 18 and is aligned at an angle close to a right angle (between about 75° and 89°) to the inserting direction ID of the terminal fitting 30 into the cavity 11. As shown in FIG. 1, the locking surface 19 is inclined forward in an overhanging or undercut manner from the base end that is continuous with the main portion 17 towards the upper projecting end when the locking lance 16 is in the natural state without being resiliently deformed.

Figure 2:
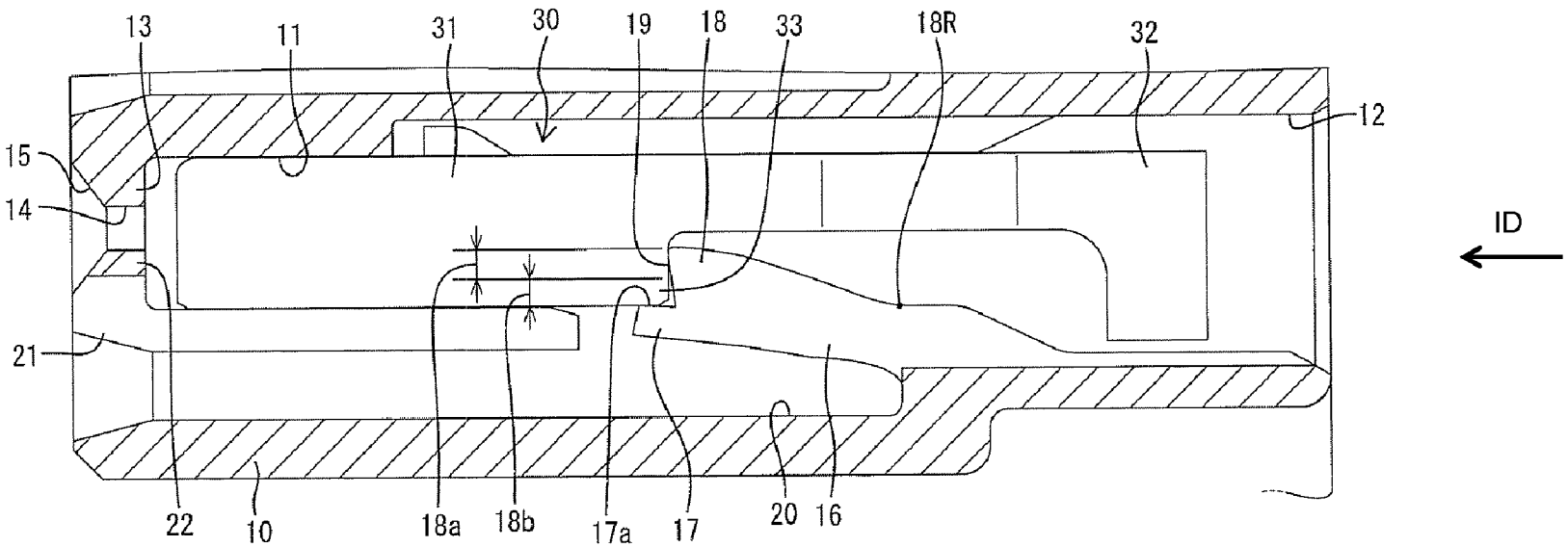
FIG. 2 is a section showing the locking lance deformed resiliently towards the cavity as a terminal fitting is displaced backward.

As shown in FIG. 2, the locking surface 19 still inclines forward in an overhanging or undercut manner from the base end towards the projecting end even when the locking lance 16 is deformed resiliently towards the cavity 11 and the upper surface 17*a* at a front end of the main portion 17 is at substantially the same height as the inner surface of the bottom wall of the cavity 11. The projecting end of the locking projection 18 is below the bottom of the opening edge of the entrance hole 14 when the locking lance 16 is not deformed resiliently.

A first locking area 18*a* is defined at an upper portion (a substantially upper half) of the locking projection 18 in the vertical direction and is engageable with the terminal fitting 30 when the locking lance 16 is not deformed resiliently. In other words, the first locking area 18*a* is at least partly in the cavity 11 in the state where the locking lance 16 is not resiliently deformed.

On the other hand, a second locking area 18*b* is defined at a lower portion (a substantially lower half) of the locking projection 18 in the vertical direction. The second locking area 18*b* is not engaged with the terminal fitting 30 in the state where the locking lance 16 is not resiliently deformed, but is to be engaged with the terminal fitting 30 when the locking lance 16 is resiliently deformed towards the cavity 11. In other words, this second locking area 18*b* is retracted from the insertion path of the terminal fitting 30 into the cavity 11 when the locking lance 16 is not resiliently deformed, but is in the cavity 11 when the locking lance 16 is deformed resiliently towards the cavity 11.

A length from the locking surface 19 to a rear end 18R of the locking projection 18 in the state where the first locking area 18*a* is engaged with the terminal fitting 30 substantially equals a length from the locking surface 19 to the rear end 18R of the locking projection 18 in the state where the second locking area 18*b* is engaged with the terminal fitting 30.

An area of the housing 10 below the locking lance 16 and opposite the cavity 11 is recessed to define a deformation space 20 for permitting a downward deformation of the locking lance 16 in the deforming direction DD away from the cavity 11. The deformation space 20 opens in the front surface of the housing 10. A space before the locking lance 16 also opens in the front surface of the housing 10. The space before the locking lance 16 and the space before the deformation space 20 vertically communicating with each other to define a mold removal space 21 that is formed upon removing a mold (not shown) for forming the locking lance 16 and the deformation space 20. A direction of removing the mold is substantially parallel to the inserting direction ID of the terminal fitting 30 into the cavity 11.

Figure 3:
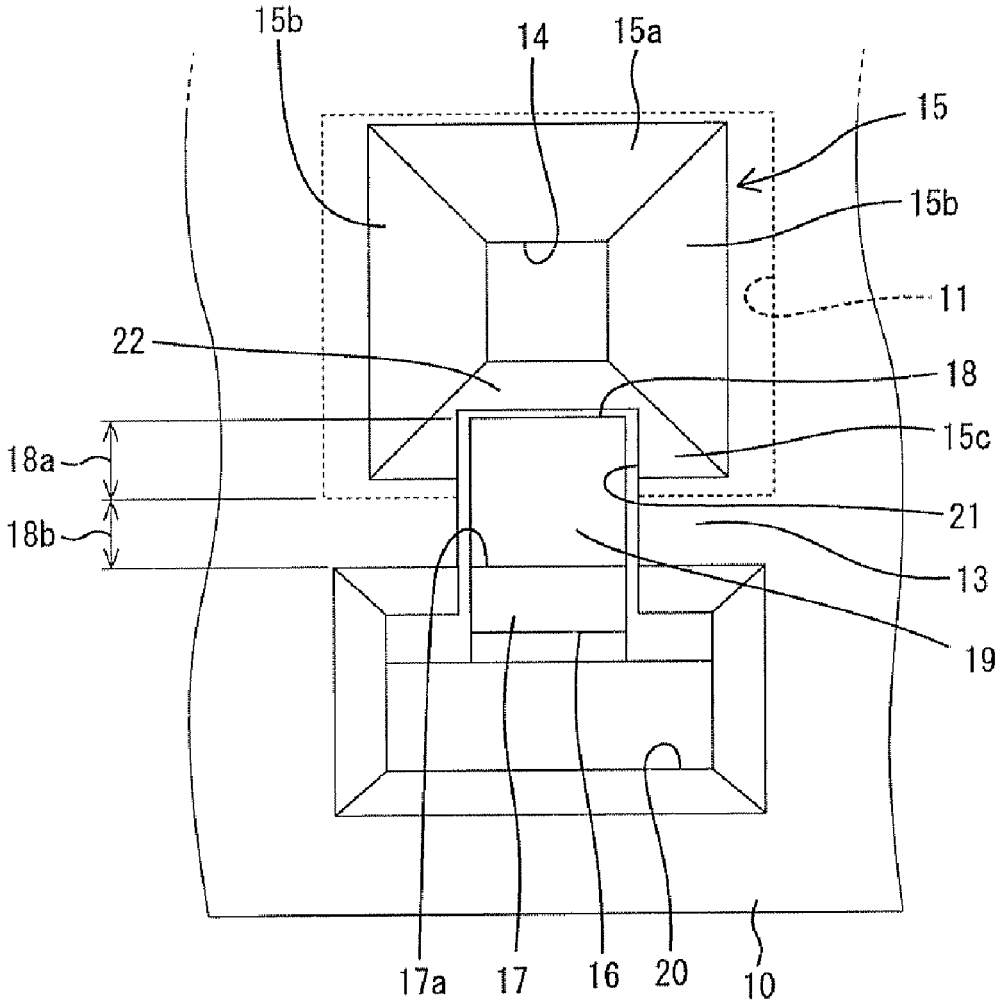
FIG. 3 is a front view showing the state where the locking lance is not resiliently deformed towards the cavity.
Figure 4:
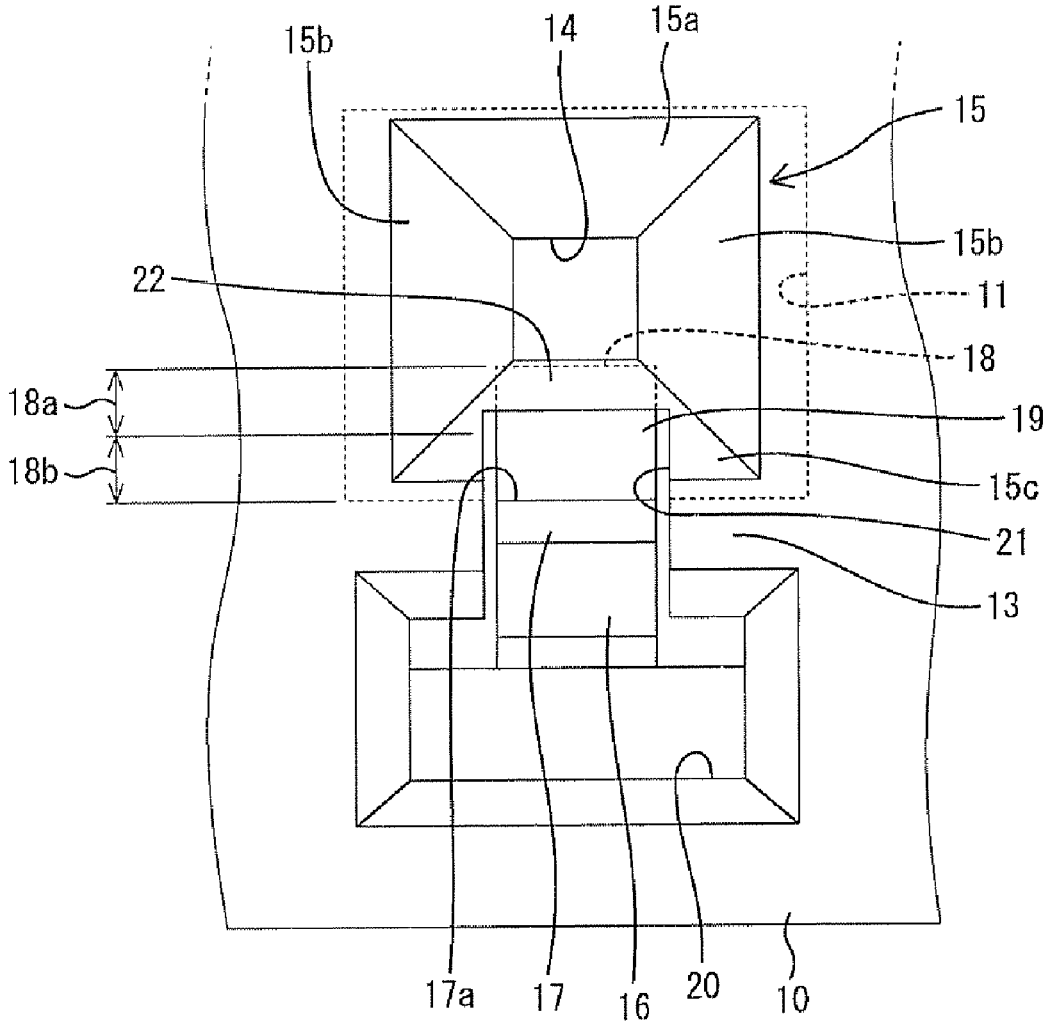
FIG. 4 is a front view showing the locking lance is deformed towards the cavity as the terminal fitting is displaced backward.
Figure 5:
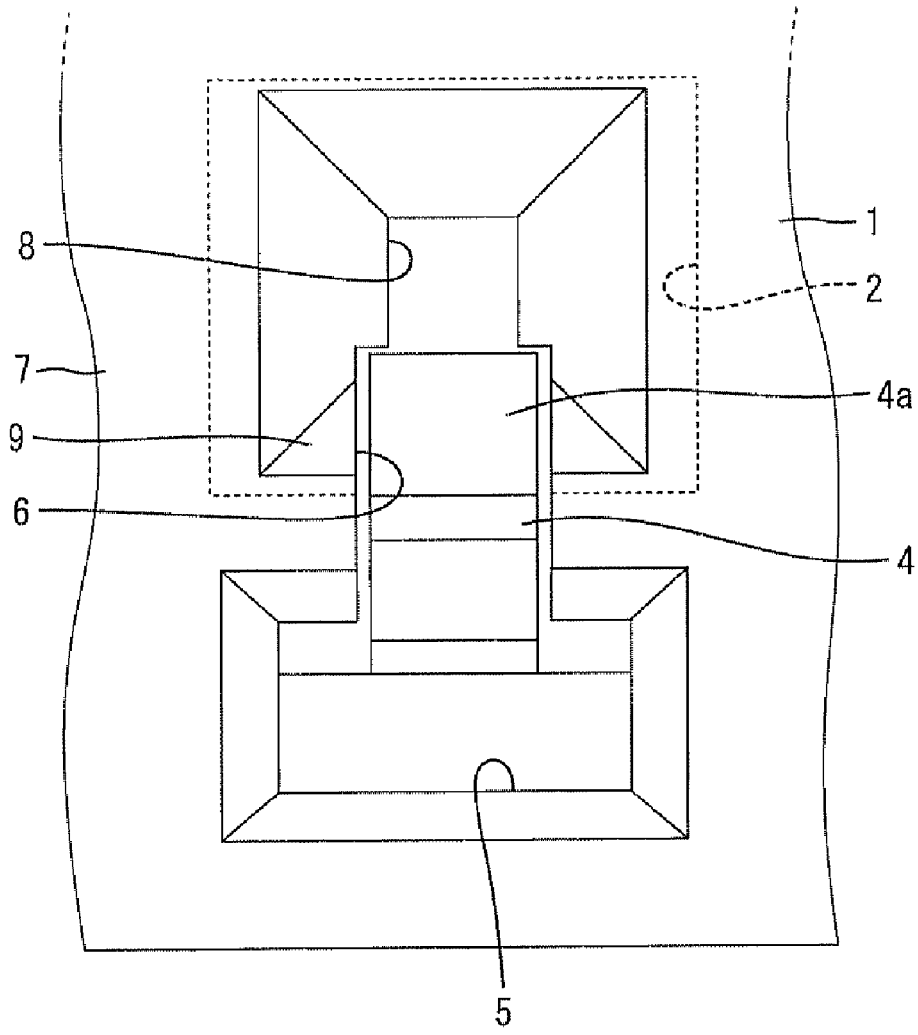
FIG. 5 PRIOR ART
FIG. 5 is a section showing a state where a locking lance with conventional dimensions is engaged with a terminal fitting.
Figure 6:
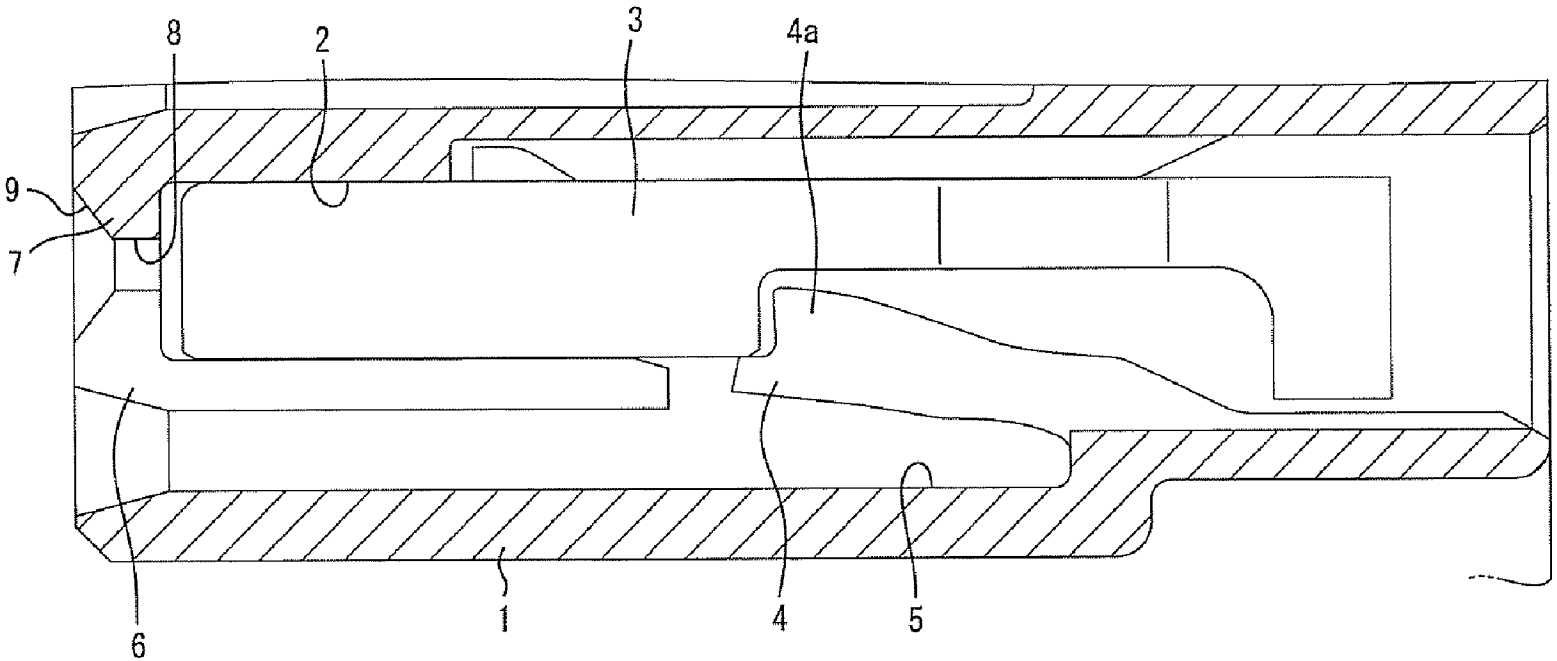
FIG. 6 PRIOR ART
FIG. 6 is a front view showing a state where the locking lance is engaged with the terminal fitting.

The mold removal space 21 cuts out a part of the front wall 13 of the cavity 11 at the front end of the housing 10. A necessary and minimum cutout area of the mold removal space 21 in the front wall 13 is an area from the bottom end of the deformation space 20 to the upper projecting end of the locking projection 18 in the vertical direction. The upper end of the locking projection 18 in the state where the locking lance 16 is not deformed is below the bottom of the opening edge of the entrance hole 14, as shown in FIG. 3. Thus, a partition 22 that divides the entrance hole 14 and the mold removal space 21 is formed at the front wall 13. The front surface of the partition 22 constitutes a part of the third guiding surface 15*c*. The partition 22 forms the entrance hole 14 as a window closed over substantially the entire periphery.

The terminal fitting 30 is a female terminal fitting with a known construction and is long and narrow in forward and backward directions FBD. A rectangular tubular box 31 is formed at a front part of the terminal fitting 30 and a wire crimping portion 32 with at least one open barrel is formed at rear part of the terminal fitting 30. The wire crimping portion 32 is to be crimped, bent or folded into connection with an unillustrated wire. The box 31 has an open front end and an unillustrated resilient contact piece is accommodated therein. The tab of the mating terminal inserted into the cavity 11 through the entrance hole 14 enters the box 31 to resiliently contact the resilient contact piece. The front end of the wire crimping portion 32 is substantially continuous with an upper part of the rear end of the box 31, and a lock 33 is formed at a bottom end of the rear end of the box 31 for engaging the locking projection 18 of the locking lance 16.

The terminal fitting 30 is inserted into the cavity 11 from behind and along the inserting direction ID. The box 31 contacts the locking projection 18 and deforms the locking lance 16 down in the deforming direction DD. Thus, the locking lance 16 enters the deformation space 20, and the lock 18 is retracted down in the deforming direction DD from the cavity 11. The box 31 passes the locking projection 18 when the terminal fitting 30 reaches a proper insertion position. Therefore the locking lance 16 resiliently deforms up and in along the deforming direction D and the first locking area 18*a* of the locking projection 18 (locking surface 19) is engageable with the lock 33 of the terminal fitting 30 in a withdrawal direction or from behind as shown in FIG. 1. At this time, the second locking area 18*b* is below the lock 33 and does not engage the lock 33. Thus, an area of engagement of the locking projection 18 (locking surface 19) and the terminal fitting 30 in the vertical direction is an area from the bottom end to the upper end of the first locking area 18*a* (preferably substantially half area of the height range of the locking projection 18).

A clearance in forward and backward directions FBD exists between the locking surface 19 of the locking projection 18 and the lock 33 of the terminal fitting 30 when the locking lance 16 deforms resiliently. The clearance is formed because the projecting end of the locking projection 18 is displaced obliquely up towards the back and the locking surface 19 of the locking projection 18 is inclined back in an undercut manner from the projecting end of the locking projection 18 towards the base end when the locking lance 16 is restored resiliently with the rear end thereof as a support.

A tensile force may act on the wire drawn out from the rear of the housing 10 and hence the terminal fitting 30 tries to displace in the withdrawing direction. As a result, the lock 33 of the terminal fitting 30 pushes the overhanging locking surface 19 from the front. Thus, the locking lance 16 is moves up towards the terminal fitting 30 due to the inclination of the locking surface 19. The front end of the main portion 17 of the locking lance 16 contacts the lower surface of the box 31 of the terminal fitting 30 to limit upward deformation of the locking lance 16 due to the pressing force of the terminal fitting 30. In this state, as shown in FIG. 2, the second locking area 18*b* of the locking projection 18 contacts the lock 33 in the withdrawal direction and retains the terminal fitting 30. The area of engagement of the terminal fitting 30 and the locking projection 18 in the vertical direction at this time is the combined area of the first and second locking areas 18*a*, 18*b*, which exceeds an area of engagement by only the first locking area 18*a*.

As described above, the locking lance 16 is displaced towards the cavity 11 when the terminal fitting 30 is pulled back in the withdrawing direction, thereby increasing the engagement area between of the locking projection 18 and the terminal fitting 30 and improving the locking function of the locking projection 18. Accordingly, the locking projection 18 need not project as far into the cavity 11 in the state shown in FIG. 1 where the locking lance 16 is not deformed, i.e. when the locking lance 16 is formed by the mold. The mold removal space 21 is formed in the front wall 13 to remove the mold that forms the locking lance 16. However, the reduction of the projecting amount of the locking projection 18 into the cavity 11 means that the mold removal space 21 can be moved down with respect to the entrance hole 14, as shown in FIG. 3. Therefore, the vertical dimension of the partition 22 is increased and the guiding area of the guiding slant 15 is enlarged.

The locking surface 19 of the locking projection 18 is inclined forward in the overhanging or undercut manner from the base end towards the projecting end when the locking lance 16 is not deformed. This inclination of the locking surface 19 ensures that a rearward pressing force exerted by the terminal fitting 30 on the locking projection 18 will move the locking lance 16 reliably towards the cavity 11.

The locking surface 19 of the locking projection 18 is inclined forward in the overhanging or undercut manner from the base end towards the projecting end even when the locking lance 16 is deformed towards the cavity 11. Thus, there is no likelihood that the locking projection 18 will disengage from the terminal fitting 30 even when the second locking area 18*b* is engaged with the terminal fitting 30.

The invention is not limited to the above described and illustrated embodiment. For example, the following embodiments are also embraced by the technical scope of the present invention.

The locking projection may be engaged with a locking hole formed in the box without being limited to the engagement with the rear end of the box of the terminal fitting.

Although the first and second locking areas preferably have the same angle of inclination, they may have different angles of inclination.

The locking surface of the locking projection may be at a right angle to the inserting direction of the terminal fitting instead of being inclined forward when the locking lance is not deformed.

The locking surface of the locking projection may be at a right angle to the inserting direction ID of the terminal fitting instead of being inclined forward from the base end towards the projecting end when the locking lance is resiliently deformed toward the cavity.

Although the locking lance is at the central position of the cavity in the width direction in the above embodiment, it may be offset laterally from the center of the cavity in the width direction.

Although the locking lance is at the central position of the entrance hole in the width direction in the above embodiment, it may be offset laterally from the center of the entrance hole in the width direction.

Although the locking lance is wider than the entrance hole in the above embodiment, it may be narrower than the entrance hole.

The locking lance need not to be cantilevered, but may be bridge-like (i.e. supported at both ends) and be displaced seesaw-like.

What is claimed is:

1. A connector, comprising:

a housing formed with at least one cavity for receiving a terminal fitting inserted in an inserting direction, a locking lance extending forward along an inner wall of the cavity and resiliently deformable in a direction intersecting with the inserting direction of the terminal fitting into the cavity, and a locking projection projecting from the locking lance for engaging and retaining the terminal fitting, the locking projection including a first locking area arranged at a projecting end of the locking projection and engageable with the terminal fitting when the locking lance is not resiliently deformed, and a second locking area arranged at a base end of the locking projection the second locking area not being engaged with the terminal fitting when the locking lance is not resiliently deformed, but being engageable with the terminal fitting when the locking lance is deformed towards the cavity, wherein a deformation space is provided for permitting the resilient deformation of the locking lance, a space before the locking lance communicating vertically with a space before the deformation space to define a mold removal space that is formed upon removing a mold for forming the locking lance and the deformation space, and a direction of removing the mold being substantially parallel to the inserting direction of the terminal fitting into the cavity and a partition is formed at a front wall of the cavity between the entrance hole and the mold removal space.

2. The connector of claim 1, wherein an entrance hole penetrates a front wall of the cavity for permitting entrance of a mating terminal into the cavity.

3. The connector of claim 2, wherein a guiding slant is formed in a front surface of the front wall and at least partly surrounding the entrance hole, the guiding slant being inclined to guide the mating terminal to the entrance hole.

4. The connector of claim 1, wherein a locking surface of the locking projection engageable with the terminal fitting is inclined forward from the base end thereof toward the projecting end thereof in the state where the locking lance is not resiliently deformed.

5. The connector of claim 4, wherein the locking surface is inclined forward from the base end thereof toward the projecting end thereof in a state where the locking lance is deformed towards the cavity.

6. The connector of claim 1, wherein with the locking lance resiliently deformed, there is a clearance in forward and backward directions between a locking surface of the locking projection engageable with the terminal fitting and a locking portion of the terminal fitting.

7. The connector of claim 1, wherein a length from a locking surface of the locking projection engageable with the terminal fitting to a rear end of the locking projection in the state where the first locking area engages the terminal fitting substantially equals a length from the locking surface to the rear end of the locking projection in the state where the second locking area engages the terminal fitting.

8. The connector of claim 1, wherein the locking lance has a cantilevered main portion extending substantially forward and having a substantially equal width as the locking projection.

9. A connector housing with opposite front and rear ends, the housing comprising at least one cavity extending from the rear end towards the front end, a locking lance formed in the housing, the locking lance having a resiliently deformable main portion extending forward along an inner wall of the cavity, a locking projection projecting from the main portion and into the cavity, the locking projection having a forwardly facing locking surface that is inclined forwardly towards the front end, the locking surface having a first locking area that is in the cavity when the locking lance is not deformed and a second locking area that is offset from the cavity when the locking lance is not deformed, the second locking area being movable into the cavity as the main portion of the locking lance is deformed towards the cavity, a front wall at the front end of the housing and an entrance hole formed through the front wall and communicating with the cavity, a mold removal space formed through the front wall and aligned with the locking lance, the mold removal space being spaced from the entrance hole, the front wall includes a partition between the entrance hole and the mold removal space, the partition having a front surface inclined rearwardly from the mold removal space to the entrance hole.

10. The housing of claim 9, wherein the main portion of the locking lance has a front end, the locking projection being rearward of the front end.

11. A connector, comprising:

a housing with opposite front and rear ends and at least one cavity extending from the rear end towards the front end, a front wall at the front end of the housing and an entrance hole formed through the front wall, the entrance hole communicating with the cavity;

a terminal fitting having a substantially tubular box inserted in the cavity and a rearwardly facing lock;

a locking lance formed in the housing, the locking lance having a resiliently deformable main portion extending forward along an inner wall of the cavity, the main portion having a front end, a locking projection rearward of the front end of the main portion and projecting from the main portion into the cavity, the locking projection having a forwardly facing locking surface that is inclined forwardly towards the front wall, the locking surface having a first locking area that is in the cavity and engaged with the lock of the terminal fitting when the locking lance is not deformed and a second locking area that is offset from the cavity when the locking lance is not deformed, whereby the second locking area is movable into the cavity and into engagement with the lock of the terminal fitting as the terminal fitting is moved rearwardly in the cavity, areas of the main portion between the front end of the main portion and the locking projection being engageable with the tubular box of the terminal fitting to limit deformation of the main portion into the cavity, a mold removal space formed through the front wall and aligned with the locking lance, the mold removal space being spaced from the entrance hole, and the front wall including a partition between the entrance hole and the mold removal space, the partition having a front surface inclined rearwardly from the mold removal space to the entrance hole.

* * * * *